US006250384B1

(12) United States Patent
Beauquin

(10) Patent No.: US 6,250,384 B1
(45) Date of Patent: Jun. 26, 2001

(54) INSTALLATION FOR PUMPING A LIQUID/ GAS TWO-PHASE EFFLUENT

(75) Inventor: Jean-Louis Beauquin, Saint-Faust (FR)

(73) Assignee: Elf Exploration Production (FR)

( * ) Notice: Subject to any disclaimer, the term of this patent is extended or adjusted under 35 U.S.C. 154(b) by 0 days.

(21) Appl. No.: 09/142,167

(22) PCT Filed: Jan. 28, 1998

(86) PCT No.: PCT/FR98/00157

§ 371 Date: Jun. 11, 1999

§ 102(e) Date: Jun. 11, 1999

(87) PCT Pub. No.: WO98/34009

PCT Pub. Date: Aug. 6, 1998

(30) Foreign Application Priority Data

Jan. 31, 1997 (FR) ..... 97 01113

(51) Int. Cl.[7] ..... E21B 43/00; E21B 43/38

(52) U.S. Cl. ..... 166/105.5; 166/106; 166/370

(58) Field of Search ..... 166/105, 105.5, 166/105.6, 106, 188, 265, 370

(56) References Cited

U.S. PATENT DOCUMENTS

| | | | | |
|---|---|---|---|---|
| 1,757,267 | * | 5/1930 | Stanley | 166/105.6 X |
| 2,030,159 | * | 2/1936 | Scott | 166/105.6 |
| 2,080,622 | * | 5/1937 | McMahon | 166/105.5 |
| 2,872,985 | * | 2/1959 | Bertuzzi et al. | 166/105.5 |
| 3,746,089 | * | 7/1973 | Vencil | 166/106 |
| 4,481,020 | * | 11/1984 | Lee et al. | 166/105.5 X |
| 4,632,184 | * | 12/1986 | Renfroe, Jr. et al. | 166/105.5 |
| 4,676,308 | * | 6/1987 | Chow et al. | 166/105.5 X |
| 5,259,450 | * | 11/1993 | Fischer | 166/106 X |

* cited by examiner

*Primary Examiner*—George Suchfield
(74) *Attorney, Agent, or Firm*—Blank Rome Comisky & McCauley, LLP

(57) ABSTRACT

The invention concerns a pumping installation designed for being mounted in an oil well extending from the surface to a layer of oil-bearing rock, comprising a pipe column at the lower end of which is mounted a pump, a joint, mounted in the well around the pipe column and delimiting a chamber at the lower end of the well, in which is arranged a pump. The installation further comprises a hydro-ejector, in the pipe column, including a lower pressure zone opening into the upper end of the chamber.

5 Claims, 1 Drawing Sheet

INSTALLATION FOR PUMPING A LIQUID/GAS TWO-PHASE EFFLUENT

BACKGROUND OF THE INVENTION

1. Field of the Invention

Figure 1:
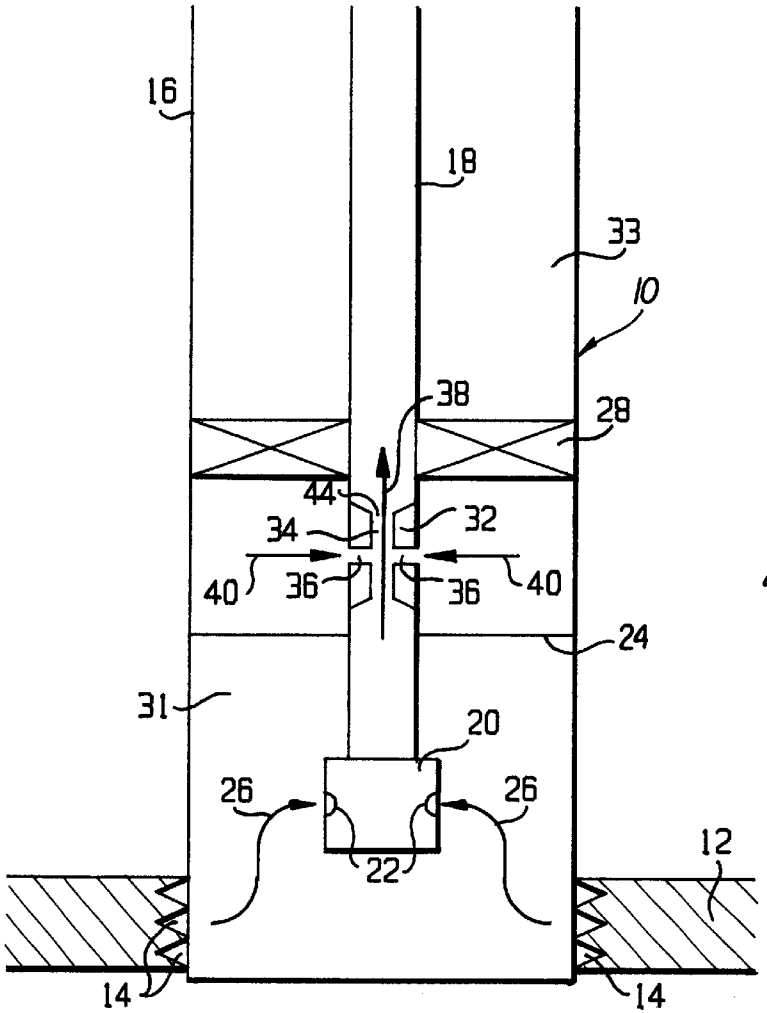

The present invention relates to an installation for pumping a liquid/gas two-phase effluent and, more specifically, to such an installation for pumping hydrocarbons from an oil well.

2. Description of Related Art

In some oil wells, the natural flow of hydrocarbons from the bottom to the surface is not sufficient to allow or to sustain commercial production. This is due either to the viscosity and to the weight of the effluents, or to a natural pressure at the bottom of the well which is too low in comparison with the factors which oppose the raising of these effluents to the surface. In order to allow the well to be exploited on a commercial scale it is advisable to use a system for artificially raising the effluent, or well-activation system. For example, a pump may be mounted at the lower end of a production tube located in the well, or an installation for injecting gas into the bottom of the well may be provided. The latter type of installation, more commonly known as a gas lift, is used to lighten the column of hydrocarbons located in the well in order to make it easier to raise to the surface.

An installation for injecting gas into the bottom of a well is generally reliable, but has the drawback of requiring, on an isolated site, a source of pressurized gas, for example a compressor and its associated pipe-work.

The use of a pump, placed at the lower end of a tubing via which the liquid/gas two-phase effluent is raised to the surface, has drawbacks when this effluent contains a significant proportion of gas. The bubbles contained in the effluent are compressible, a fraction of the pump energy being used to compress the gas rather than to convey the fluid to the surface. This phenomenon may even lead to the flow rate of pumped fluid becoming zero (a situation commonly known as cavitation or gas lock). Centrifugal pumps are particularly susceptible to gas lock, particularly in wells because they are situated at the foot of a column of fluid which, on account of its own weight, creates a hydrostatic back pressure which, even at zero flow rate, opposes delivery. What is more, during flow stoppages, the gases and liquids end up separating under gravity at the bottom of the well and this, under certain circumstances, creates severe malfunctioning of the pump when it restarts if the accumulated gas enters the pump or even if, under these transient conditions, a large bubble of gas has been formed inside the pump.

It is therefore advisable for most of the gas to be separated from the liquid phase of the effluent before this liquid is drawn in by the pump. Thus, all the pump energy can be expended in conveying the liquid to the surface, and the risks of cavitation are reduced.

However, this separating of gas upstream of the pump requires a gas discharge pipe which differs from the one used by the liquid passing through the pump. A common way of fulfilling this function is to let the gas "ventilate"—that is to say travel—through the annular space there is between the internal wall of the well casing and the external wall of the tubing used for the flow of the pumped liquid. This method does, however, present a number of major drawbacks, the consequence of which is that of making the exploitation of the well more expensive and even dangerous: in particular the loss of natural raising energy; the chemical and/or mechanical attack of the materials in contact with the gas; and significant and uncontrollable exchanges of heat between the effluents and the perimeter of the well, which may give rise to expensive flow problems.

In order partially to alleviate these drawbacks, the document FR-A-2,723,143 describes an installation for an oil well comprising a pump placed at the lower end of a first tubing, a second tubing being intended to receive, as necessary, gas from the effluent and separated upstream of the pump, and to convey it as far as the surface independently of the liquid phase. In this document, in order to encourage the separation of the gas from the effluent at the bottom of the well, the pump has a sleeve which extends as far as a level below the layer of oil-bearing rock. Thus, the effluent entering the well is forced to flow downwards before being drawn up by the pump, and this has the effect of guaranteeing excellent separation of the gas intended to take the independent tubing.

The installation described in document FR-A-2,723,143, although allowing the pump to receive an effluent that contains a low gas content, does, however, have drawbacks in that it requires a second tubing along the entire length of the well, something which results in substantial dimensional and economic constraints in the work. Furthermore, the column of liquid effluent raised to the surface by the pump is heavy, because it is essentially free of gas, and this means that a greater pumping power is required.

SUMMARY OF THE INVENTION

The subject of the present invention is therefore an installation for pumping a liquid/gas two-phase effluent which is of simple, robust and reliable construction, and which is not subject to the aforementioned drawbacks.

In order to achieve this objective, the present invention provides a pumping installation intended to be mounted in a well, extending from the surface down to a layer of oil-bearing rock, comprising a tubing, at the lower end of which a pump is mounted, a seal mounted in the well around the tubing and delimiting a chamber at the lower end of the well, in which chamber the pump is placed, characterized in that the installation additionally comprises a hydro-ejector, in the tubing, comprising a depression zone opening into the upper end of the chamber.

Other features and advantages of the present invention will emerge more clearly from reading the description hereafter, given with reference to the appended diagrams and drawings:

BRIEF DESCRIPTION OF THE FIGURES OF DRAWINGS

Figure 2A:
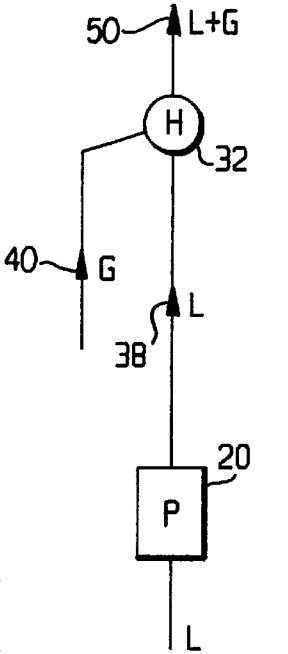
Figure 2B:
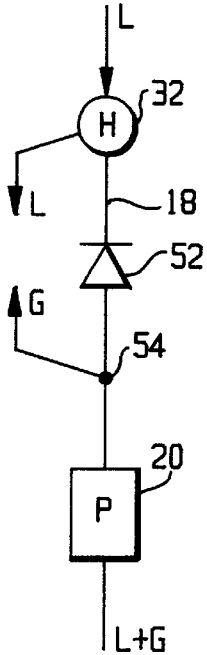
Figure 2C:
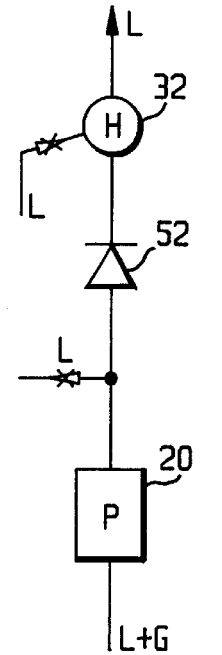

FIG. 1 is a view in longitudinal section of an installation according to a first embodiment of the invention, and FIGS. 2*a* to 2*c* are diagrammatic views of three modes of operation of the invention.

DETAILED DESCRIPTION OF THE PREFERRED EMBODIMENT

As depicted in FIG. 1, an oil well 10 extends between the surface (not depicted) and a layer of oil-bearing rock 12. The well has perforations 14 opening into the oil-bearing rock, and which allow the hydrocarbon effluent to flow into the well 10. The well 10 comprises a casing 16 which seals it against the layers of rock through which the well passes. Inside the well, a tubing 18 extends between the surface and a point a few meters above the layer of rock 12. The tubing 18 at its lower end has a pump 20 which is fitted with inlets 22 for the effluent to be conveyed to the surface. In the example depicted, the pump 20 is a rotary centrifugal pump and its motor is powered from the surface by an electric lead (not depicted). Before being drawn in by the pump 20, the effluent from the layer of rock 12, which fills the well up to a level 24, moves in the direction of the arrows 26. During this movement, the gas contained in the effluent is released and rises up inside the well as far as a seal 28, more commonly known as a packer, thus forming a gas pocket 30 between the level 24 of the liquid effluent and the seal 28, in a chamber 31 defined in the well 10 below the packer 28. The pump 20 may advantageously comprise a special baffle-type or dynamic separator of the centrifugal or vortex type for better ensuring separation upstream of the pump (not depicted). Without such a separator, separation usually takes place by gravity in the chamber 31 where there are to be found, at a relatively low speed given the cross-section of their passage, the crude effluents emerging from the perforations.

The packer 28 defines an annular chamber 33 delimited by the internal wall of the casing 16 and the external wall of the tubing 18 between the seal 28 and the surface. The packer 28 prevents the effluents and in particular the gas from entering the chamber 33. They cannot cross through the upper part of the well except by taking the tubing 18. The chamber 33 and all the accessories it contains, such as the power lead for the pump 20, are therefore spared from mechanical and chemical attack and remains available for other functions such as, for example, receiving a lagging substance for thermally insulating the tubing 18.

In the region of the gas pocket 30, the tubing 18 comprises a liquid-gas hydro-ejector 32, or venturi, intended to create a depression region 34 inside it by a venturi effect. The liquid-gas hydro-ejector 32 comprises orifices 36 placing the depression zone 34 and the gas pocket 30 in communication.

When the above-described pumping installation is set in operation, the pump 20 is set in motion, drawing up liquid effluent through the inlets 22 and delivering it, in the direction of the arrow 38, towards the surface. The passage of the effluent through the liquid-gas hydro-ejector 32 creates a depression inside it because of its geometry in the shape of a convergent nozzle, which depression causes gas to be drawn through the orifices 36 from the gas pocket 30 in the direction of the arrows 40. Inside the hydro-ejector, the gas is then entrained by the liquid effluent from the pump 20 with which it mixes and recombines, this lightening the column of effluent contained in the tubing 18, thus making it easier to raise towards the surface.

As the gas pocket 30 is always in communication with the tubing 18 via the orifices 36; 44, the formation of a gas pocket extending as far as the pump 20 is avoided, even in the event of prolonged installation shut-down. The result of this is that it avoids the pump re-starting when surrounded by gas.

FIG. 2*a* diagrammatically depicts the normal configuration of flow, corresponding to that described hereinabove with reference to FIG. 1. The modes of operation of the invention which are depicted in FIGS. 2B and 2C include additional features that allow the installation better to react to transient or fleeting degraded situations, and allowing it to be made more effective and efficient.

FIG. 2A diagrammatically repeats the features of the installation of FIG. 1. The liquid delivered by the pump 20 in the direction of the arrow 38 draws gas into the hydro-ejector 32 in the direction of the arrow 40. The mixture of liquid recombined with gas is sent towards the surface by the tubing 18 in the direction of the arrow 50.

FIG. 2B diagrammatically depicts the situation in which, in an installation according to the invention, the pump 20 draws in effluent which contains a high proportion of gas or contains large gas bubbles in its impellers. Centrifugal pumps are somewhat intolerant of gas bubbles, not being designed to deliver-such effluents. It is therefore advisable to facilitate the discharge of these bubbles towards the pump outlet before continuing to convey effluent towards the surface.

The problem is that the presence of large gas bubbles within the pump 20 may arise despite the gas being separated upstream before the fluids enter the pump 20, on account, for example, of an additional release of gas actually within the pump 20, or alternatively, during a transient operating phase such as re-starting the installation. To avoid such a situation being prolonged and becoming stationary to the detriment of the equipment which would overheat and to the detriment of the well production which would become zero, the invention proposes that the delivery of the pump 20 be relieved with, on the one hand, a non-return valve 52 in the tubing 18 between the pump 20 and the hydro-ejector 32 in order to prevent the return of the effluents towards the pump 20 and to support the weight of the hydrostatic head and, on the other hand, a lateral opening 54 situated below this valve and allowing lateral discharge of effluents consisting essentially of gas towards the annular chamber 31. This valve 52 and the lateral opening 54 are preferably systems which can be put in place and withdrawn from the well by cable using an operation commonly known as a wire line operation, so as to make them inexpensive to maintain. It is possible, for example, to use equipment housed in lateral pockets of the type commonly used for the valves for injecting gas for lightening the column of effluent and commonly known as side pockets. The lateral opening 54 has to close again as soon as a certain flow rate of liquid effluent and a higher pressure become reestablished at the delivery of the pump 20. The operation of this lateral opening 54 may either be controlled from the surface using an electric or hydraulic control line on the basis of parameters available at the surface, or may alternatively be controlled automatically and locally for example using the delivery pressure of the pump 20, or the pressure difference due to friction of the effluent between the inlet and the outlet of the lateral opening 54. This principle is used in safety valves known as storm chokes.

As depicted in FIG. 2B, when the pump is no longer conveying liquid effluent towards the surface, the column of liquid present in the tubing 18, downsteam of the hydro-ejector 32 flows, under the effect of its own weight, until equilibrium is established, through the orifices 36 formed in the hydro-ejector towards the chamber 31. Once the tubing has emptied and equilibrium has been established, the gas present in the chamber 31 can rise up to the surface, entering the tubing 18 through the orifices 36. Thus, even if the level 24 of liquid effluent has dropped below the level of the pump 20, this bleeding of gas into the chamber 31 allows the liquid level 24 to rise above that of the pump 20. Once the pump again becomes immersed in liquid effluent containing a low proportion of gas, the conveying of effluent to the surface can recommence.

FIG. 2C diagrammatically depicts an installation intended to alleviate the problems that may occur when the level 24 of liquid exceeds that of the hydro-ejector 32.

Such a situation arises if the hydro-ejector has a gas intake capacity that exceeds the flow rate of gas released by the separation situated upstream of the inlet of the pump 20. This is even the most probable situation to be encountered in the normal configuration of the installation according to the invention. Now, even if the hydro-ejector is capable of operating in liquid-liquid mode as is the general case in jet-pumping it is somewhat preferable to avoid the actual entrainment of liquid from the chamber 31 by the liquid effluents flowing in the direction of the arrow 38, because such entrainment would reduce the performance and/or efficiency of the system. To avoid this entrainment of liquid, and make the entrainment selective with respect to the gas and to the liquid of the chamber 31, several solutions are proposed hereafter: the first relies on the fact that the hydro-ejector 32 is more or less capable of making this selection naturally, through hydraulic lock. This is the phenomenon which comes into play when, in liquid-liquid jet pumping, the jet causes gas lock, that is to say no longer manages to entrain liquid. This condition is obtained for a sufficiently high flow rate of entraining liquid. The second consists in using a float intended to block the lateral gas inlet of the hydro-ejector 32 when the liquid in the chamber 31 raises it. This float would, here too, be a system which could be fished out using a cable and which could, for example, be fitted into a side pocket, through which all the gas from the pocket 30 would pass before entering the hydro-ejector 32. The third, which can also be fished out using a cable, would be the equivalent of the float but with different technology, for example a flap or some other storm choke closing the liquid passage. It is also possible to envisage a small-diameter orifice or nozzle with low resistance to gas flow and very high resistance to the flow of liquid, even causing gas to be released from the latter.

The liquid-gas hydro-ejector 32 and the accessories corresponding to the functions depicted in FIGS. 2B and 2C, and the moving part of the pump are advantageously designed to allow them to be raised back up to the surface by cable when maintenance operations are required.

The liquid-gas hydro-ejector may be mounted in the tubing at a point above the seal, the depression zone communicating with the chamber via a duct which passes through the seal.

What is claimed is:

1. Pumping installation mounted in a well, extending from the surface down to a layer of oil-bearing rock, comprising a tubing, at the lower end of which a rotary centrifugal pump is mounted, a seal mounted in the well around the tubing and delimiting a chamber at the lower end of the well, in which chamber the pump is placed, and a hydro-ejector arranged in the tubing and comprising a depression zone opening into the upper end of the chamber.

2. Pumping installation mounted in a well, extending from the surface down to a layer of oil-bearing rock, comprising a tubing, at the lower end of which a pump is mounted, a seal mounted in the well around the tubing and delimiting a chamber at the lower end of the well, in which chamber the pump is placed and a hydro-ejector mounted in the tubing immediately below the seal and comprising a depression zone communicating with the upper end of the chamber via orifices formed in the hydro-ejector.

3. Installation according to claim 1, further comprising a non-return valve mounted in the tubing between the pump and the hydro-ejector to prevent the return of effluents towards the pump, and a lateral opening system provided in the tubing between the pump and this non-return valve, said opening system allowing lateral discharge of effluents into the chamber and being adapted to close when the pump conveys liquid effluents to the surface.

4. Installation according to claim 2, wherein the pump is a rotary centrifugal pump.

5. Installation according to claim 2, further comprising a non-return valve mounted in the tubing between the pump and the hydro-ejector to prevent the return of effluents towards the pump, and a lateral opening system provided in the tubing between the pump and this non-return valve, said opening system allowing lateral discharge of effluents into the chamber and being adapted to close when the pump conveys liquid effluents to the surface.

* * * * *